United States Patent [19]

Schippers et al.

[11] Patent Number: 4,911,370

[45] Date of Patent: Mar. 27, 1990

[54] METHOD AND APPARATUS FOR WINDING YARN

[75] Inventors: Heinz Schippers; Walter Runkel; Erich Lenk, all of Remscheid; Klaus Bartkowiak, Herne, all of Fed. Rep. of Germany

[73] Assignee: Barmag AG, Remscheid, Fed. Rep. of Germany

[21] Appl. No.: 130,062

[22] Filed: Dec. 8, 1987

[30] Foreign Application Priority Data

| | | | |
|---|---|---|---|
| Dec. 8, 1986 | [DE] | Fed. Rep. of Germany | 3641847 |
| Dec. 18, 1986 | [DE] | Fed. Rep. of Germany | 3643229 |
| Aug. 7, 1987 | [DE] | Fed. Rep. of Germany | 3726281 |

[51] Int. Cl.[4] ..... B65H 54/38

[52] U.S. Cl. ..... 242/18.1; 242/43 R; 242/43.1; 242/158 B

[58] Field of Search ..... 242/18.1, 43 R, 43.1, 242/158 B, 26.1, 26.2, 26.3

[56] References Cited

U.S. PATENT DOCUMENTS

| | | | |
|---|---|---|---|
| 2,285,439 | 6/1942 | Jones | 242/43 R |
| 2,296,421 | 9/1942 | Campbell | 242/43 R |
| 2,360,909 | 10/1944 | Swanson et al. | 242/43 R |
| 2,415,233 | 2/1947 | Brustowsky . | |
| 2,462,060 | 2/1949 | Bartelt . | |
| 2,764,363 | 9/1956 | Stammwitz | 242/26.2 |
| 2,911,835 | 11/1959 | Smith . | |
| 3,029,649 | 4/1962 | Steyh . | |
| 3,039,708 | 6/1962 | Chidgey, Jr. et al. | 242/26.3 |
| 3,061,215 | 10/1962 | Chidgey, Jr. et al. | 242/26.3 |
| 3,067,961 | 12/1962 | Chidgey, Jr. et al. | 242/26.3 |
| 3,093,344 | 6/1963 | Lamb . | |
| 3,589,631 | 6/1971 | Jennings et al. | 242/43 R X |
| 3,697,008 | 10/1972 | Smith | 242/43 R |
| 3,727,855 | 4/1973 | Richter | 242/18.1 |
| 3,730,448 | 5/1973 | Schippers et al. . | |
| 4,204,653 | 6/1980 | Nose et al. | 242/26.3 X |
| 4,296,889 | 10/1981 | Martens . | |
| 4,325,517 | 4/1982 | Schippers et al. . | |
| 4,504,021 | 3/1985 | Schippers et al. . | |
| 4,659,027 | 4/1987 | Schippers et al. . | |

FOREIGN PATENT DOCUMENTS

| | | | |
|---|---|---|---|
| 2320472 | 3/1977 | France . | |
| 413448 | 4/1946 | Italy | 242/158 B |
| 433892 | 10/1967 | Switzerland . | |
| 532840 | 7/1972 | Switzerland . | |
| 612 | of 1903 | United Kingdom | 242/18.1 |

OTHER PUBLICATIONS

IBM Technical Disclosure Bulletin, vol. 16, No. 1, Jun. 1973, pp. 239–240.

*Primary Examiner*—Stanley N. Gilreath

*Attorney, Agent, or Firm*—Bell, Seltzer, Park & Gibson

[57] ABSTRACT

A method and apparatus for winding a textile yarn into a cross-wound package is disclosed, in which the yarn is wound about the package at a substantially constant rate while the yarn is guided onto the package by a traversing guide. In order to avoid the formation of ribbons on the package, the traversing frequency of the yarn guide is periodically varied by shortening the stroke of the traversing yarn guide while maintaining an unchanged traversing speed of the traversing yarn guide. The avoidance of the formation of ribbons is also accomplished by varying the traversing speed of the traversing yarn guide during the times in which the traversing frequency of the traversing yarn guide is unchanged. Stops are provided for controlling the length of back-and-forth movement of the traversing yarn guide and the stops can be moved inwardly and outwardly to provide the required stroke modification of the traversing guide. Several specific embodiments of the yarn traversing apparatus are disclosed, and wherein the traversing apparatus includes gripper means mounted on a slide which is positioned between parallel runs of a drive belt, and control means for moving the gripper means to alternately engage the two runs of the belt and thus reciprocate the slide.

30 Claims, 5 Drawing Sheets

METHOD AND APPARATUS FOR WINDING YARN

FIELD OF THE INVENTION

This invention relates generally to a method and apparatus for winding textile yarn so as to produce a cross wound package of the type in which the layers are wound with an angular deposit of at least 2°. More particularly, the present invention involves the avoidance of the formation of ribbons while thus winding textile yarn.

BACKGROUND OF THE INVENTION

U.S. Pat. No. 4,296,889 discloses a method of breaking the formation of ribbons while winding textile yarns into a cross-wound package by a system known as "wobbling" in which the traversing frequency of the yarn guide is temporarily varied by accelerating and decelerating the traverse motion of the yarn guide. This system has the disadvantage that the takeup speed, which is the geometrical sum of the circumferential speed of the package and the yarn traversing speed, is varied and this results in undesirable changes in yarn tension.

It is also known from U.S. Pat. No. 3,730,448 to periodically shorten the stroke (stroke modification) when producing a cross-wound yarn package. In accordance with the method of this patent, an additional speed is positively or negatively superimposed on the traverse motion drive, i.e., a grooved roll, which always traverses the same stroke length. As a result, the traversing yarn guide crosses the stroke length assigned to it at the same traversing frequency, but at a changed traversing speed, if the traversing stroke is modified. Likewise, the method of the periodic stroke modification serves to build up an exactly cylindrical or biconical package with straight or inclined opposite sides. Also, in accordance with this method, a variation of the traversing speed causes a change of the winding speed, resulting in an undesirable change of the yarn tension.

To avoid such unacceptable changes in the yarn tension, U.S. Pat. No. 4,325,517 suggests a method in which the ribbon breaking and the stroke modification should simultaneously occur. As a result, the variation of the traversing speed for the purpose of ribbon breaking is largely compensated by the variation of the traversing speed for the purpose of stroke modification. This latter method is further developed in a manner disclosed in U.S. Pat. No. 4,659,027 so that uniformly cylindrical packages can be built up in order to permit the yarn to be unwound at speeds higher than 1,000 m/min without any problems.

SUMMARY OF THE INVENTION

In contrast to the winding systems of the prior art described above, the method and apparatus of the present invention involves a winding process wherein the traversing speed of the yarn guide is not varied as a result of the ribbon breaking and stroke modification procedures. Also, in the prior art methods, the ribbon breaking and stroke modification procedures are interrelated, and consequently, the measures for synchronization require substantial mechanical and electronic expenditures, which are not necessary with the present invention.

More particularly, the method and apparatus of the present invention includes winding the yarn about a core supported package at a substantially constant rate and while the yarn is traversed along the package at a traverse speed which is at least about 3.5% of the peripheral speed of the package, and so that the layers are wound with an angular deposit of at least about 2°. Also, the present invention includes the step of periodically varying the traversing frequency by shortening the stroke of the traversing yarn guide while maintaining an unchanged traversing speed of the traversing yarn guide. These periodic stroke modification cycles provide the advantage that the yarn can be wound at a constant and optimized yarn tension without the development of any ribbons.

In accordance with the present invention, it may be useful or necessary for reasons related to mechanical or electrical engineering or textile technology, to interpose a cycle of rest between the stroke modification cycles of shortened stroke length, in which the stroke is not shortened. During such cycles of rest, there exists the possibility that ribbons will be formed. Consequently, it is proposed that during these cycles of rest, a ribbon breaking occurs in which the traversing speed is varied.

In order to temporarily vary the traversing frequency of the yarn guide by shortening the stroke while maintaining an unchanged traversing speed, the preferred embodiment of the present apparatus includes a slide mounting the traversing yarn guide and being movable back and forth along a straight line stroke path between opposing runs of a conveyor belt. Stops are provided in the areas of the stroke ends of the slide, and gripper means is provided for drivingly connecting the slide in an alternating manner to the opposing runs of the conveyor belt. The stops are supported for inward and outward movement relative to each other to provide modification of the stroke length of the traversing guide.

In the preferred embodiments of the yarn traversing apparatus, the gripper means is mounted on the slide for movement between first and second positions for engaging opposite ones of the belt runs, and control means is provided for moving the gripper means between the first and second positions. The control means comprises the pair of stops mounted adjacent respective ends of the stroke path, and cam means mounted on the slide for movement between first and second locations by the stops, and with the cam means being interconnected to the gripper means so as to move the same between its first and second positions upon the cam means being moved between its first and second locations. Also, spring biasing means is provided for biasing the cam means toward each of its first and second locations, and with the spring biasing means having a dead center position of maximum force when the cam means is intermediate its first and second locations.

BRIEF DESCRIPTION OF THE DRAWINGS

Some of the ojbects and advantages of the present invention having been stated, others will appear as the description proceeds when taken in connection with the accompanying drawings, in which.

DESCRIPTION OF THE PREFERRED EMBODIMENT

Figure 11:
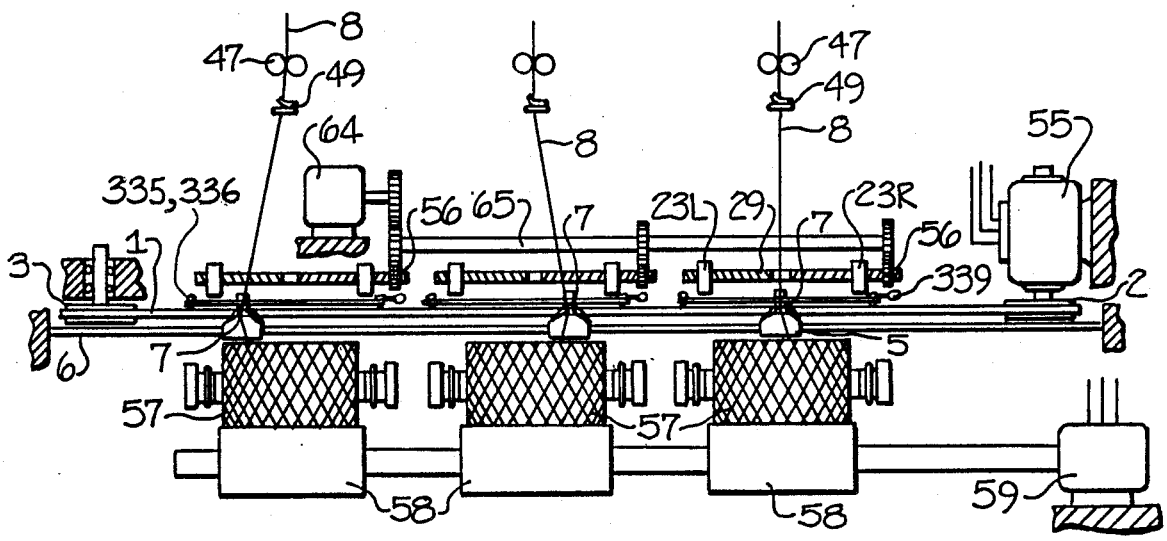
FIG. 11 is a schematic side elevation view of a winding machine having a plurality of side by side winding stations in accordance with the present invention.

Referring more particularly to the drawings, FIG. 11 illustrates a winding apparatus having a plurality of side by side winding stations. At each station, a yarn 8 is delivered at a substantially constant speed, and is wound onto a core supported package 57 which is coaxially supported on a spindle. The package 57 is driven at a constant peripheral speed by a drive roller 58 and a motor 59. During the winding operation, the yarn is traversed back and forth along the package by a yarn guide 7 which is part of a traversing apparatus as described in detail below. In winding operation of this type, the yarn is traversed at a speed which is at least about 3.5% of the speed of the yarn (which is equal to the peripheral speed of the package), and which is preferably at least about 5.7% of the speed of the yarn. These percentages represent the tangent of a crossing angle of 2° and 5° respectively, between the yarn and the tangent to the yarn on the package which is perpendicular to the axis of the package.

Figure 1:
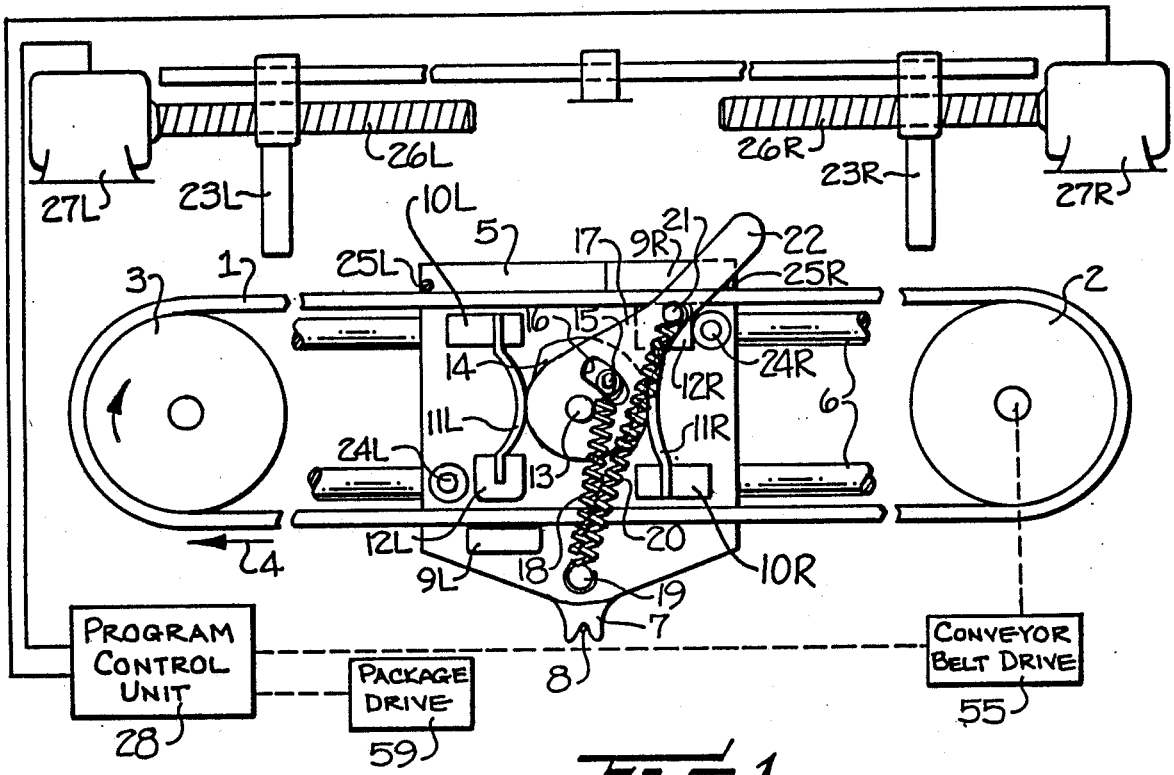
FIG. 1 is a somewhat schematic plan view of the yarn traversing apparatus of the present invention.

As more specifically shown in FIG. 1, a rotating drive in the form of a conveyor belt 1 is entrained around and extends between pulleys 2 and 3 and is rotated in the direction indicated by the arrow 4 by a conventional belt drive 55. A slide 5 is guided along straight spaced-apart guideways 6 extending between the opposite runs of the belt 1. The traversing yarn guide 7 is mounted on the slide 5 and guides a yarn 8 which is advanced vertically to the plane of the drawing and onto a cross-wound core supported yarn package, not shown in FIG. 1.

Belt gripper means is mounted on the slide 5 and between the two runs of the belt 1. This gripper means includes a stationary clamp 9 L which is attached to the slide 5 and closely adjacent to the outside of the lower belt run moving from right to left in FIG. 1. An inwardly curved or bowed spring 11 L is fixed at its upper end in a support block 10 L which is fixed on the slide 5 and in the area adjacent the belt run moving from left to right. A movable clamp 12 L is fixed on the lower end of the bowed spring 11 L so that it is out of engagement with the belt 1 when the bowed spring 11 L is in the idle position shown in FIG. 1. Movement of the slide 5 to the right is accomplished by corresponding parts 9 R to 12 R and these parts are laterally inverted relative to the corresponding parts 9 L to 12 L. Thus, the stationary clamp 9 R is fixed on the slide 5 and outside of the upper run of the belt 1 conveying the same to the right. The movable clamp 12 R is supported on the free end of the bowed spring 11 R and on the inside of the upper belt run moving to the right.

A central pivot pin 13 is supported on the slide 5 and in the center between the slide driving elements. An eccentric indexing cam in the form of a disk 14 is pivotally supported upon the pin 13 and is provided with a small diameter extending over an angle of approximately 180° and a larger diameter forming a cam surface extending over the remaining approximately 180° of the disk 14. The transition from the smaller diameter to the larger diameter provides cam surfaces which engage and tend to straighten the bowed springs 11 L and 11 R, in a manner to be presently described.

Figure 3:
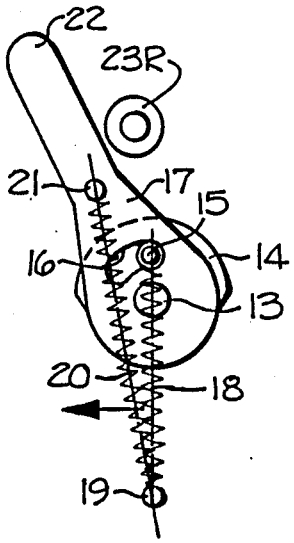

A drive pin 15 is fixed in the disk 14 and projects through an elongate slot 16 formed in a second disk 17, functioning as an indexing disk and which is also supported for pivotal movement on the central pin 13. A tension spring 18 is fixed at one end to a spring perch 19 fixed on the slide 5 and at its other end to the drive pin 15. When viewed from the spring perch 19 on the slide 5, the drive pin 15 on the disk 14 lies to the right of the pivotal pin 13. Therefore, the spring 18 moves through its dead center position, as shown in FIG. 3, when the disk 14 is rotated from the position shown in FIG. 1 to the position shown in FIG. 4.

Figure 4:
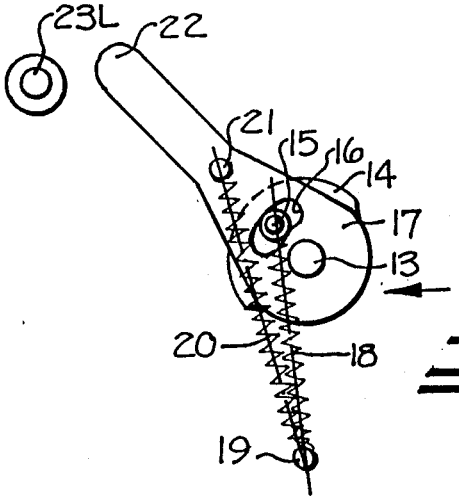

A tension spring 20 is connected at one end on the spring perch 19 mounted on the slide 5 and its other end is connected to a spring perch 21 on a radial control arm 22 which is formed integral with the disk 17. The spring perch 21 is located beyond the center of rotation of the pivot pin 13 and on a larger diameter than the clamping point of the end of the spring 18 on the disk 14. Thus, when the indexing disk 17 is pivoted, the spring 20 overtravels its dead center position, as illustrated in FIGS. 3 and 4.

The outer end of the control arm 22 is positioned to engage and cooperate with stops 23 R and 23 L when reaching respectively the right-hand and left-hand end positions of the slide 5. The stops 23 L and 23 R are supported on respective threaded spindles 26 L and 26 R, driven by respective stepping motors 27 L and 27 R. Rotation of the stepping motors 27 L and 27 R is controlled by a program cotnrol unit 28 so that the stepping motors may be rotated in both directions. The program control unit also is operatively connected to the belt drive 55 as indicated schematically in FIG. 1, for the purposes further described below. Rollers 24 L and 24 R are supported on the slide 5 and serve as stops and guides for the movable clamps 12 L and 12 R. The pivotal motion of the control arm 22 is limited by respective stops 25 L and 25 R positioned on the upper portion of the slide 5 and at opposite end portions thereof.

Figure 2:
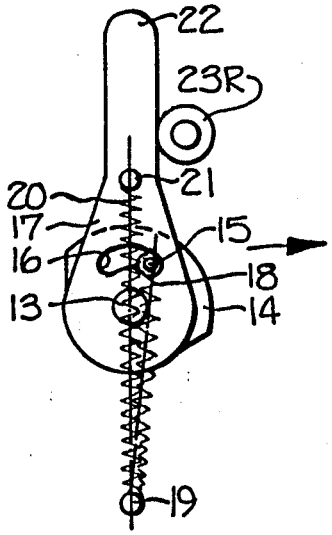
FIGS. 2–4 schematically illustrate various switched positions of the control lever for alternately drivingly connecting the slide block to the opposing runs of the driving conveyor belt.

As illustrated in FIG. 1, the traversing slide 5 is moving to the right because it is attached to the upper belt run or segment which is moving to the right, by means of the stationary clamp 9 R and the movable clamp 12 R. The slide 5 continues to move to the right until the control arm 22 contacts the right-hand stop 23 R. As the control arm 22 engages the right-hand stop 23 R, as shown in FIG. 2, the disk 14 does not immediately follow the pivotal movement because of the lost motion interconnection formed by the drive pin 15 on the disk 14 moving along the slot 16 in the indexing disk 17. As the indexing disk 17 moves to the dead center position shown in FIG. 2, the tension spring 20 extends above the center of the pivot pin 13. However, the position of the disk 14 is substantially still unchanged, so that the disk 14 continues to tension the bowed spring 11 R with the large diameter cam surface thereof. Thus, the movable clamp 12 R and the fixed clamp 9 R still engage opposite sides of the drive belt 1.

With further movement of the slide 5 to the right, the oblong slot 16 in the indexing disk 17 reaches its end so that the drive pins 15 on the disk 14 is moved in a counterclockwise direction. When the dead center position of the indexing disk 14 is overtraveled, as illustrated in FIG. 3, the force of the tension spring 20 becomes operative. At this point, it is important that the pivotal spring perch 21 of the spring 20 on the indexing disk 17 is further removed from the common pivot perch 19 of the springs than the drive pin 15 on the disk 14, which serves simultaneously as the pivot point of the spring 18. Consequently, the pressure exerted by the spring 20 on the assembly of the indexing disk 17 and the disk 14 overcomes the oppositely directed force exerted by the spring 18. This action results in the control arm 22 being rotated in a counterclockwise direction to the end position shown in FIG. 4.

When moved to the position of FIG. 4, the large diameter area of the disk 14 contacts the left-hand bowed spring 11L to tend to straighten the same. Consequently, the belt segment now moving to the left is frictionally engaged by the stationary clamp 9 L and the movable clamp 12 L to grip the lower run of the belt 1 and move the slide 5 to the left. When the control arm 22 moves against the left-hand stop 23 L, the lever arm 17*a* is moved in a clockwise direction and the slide 5 is drivingly connected to the upper reach of the belt 1 so that the yarn guide 7 moves to the right in FIG. 1.

The stepping motors 27 L and 27 R may be driven at the same time or individually in such a manner that the stops 23 L and 23 R are moved individually or preferably both synchronously in the direction of the center of the stroke of the yarn guide 7. This movement may be controlled by a predetermined program in the program control unit 28 to produce the required type of stroke modification. As stated heretofore, these principles for the control are described in U.S. Pat. No. 4,659,027, as well as in copending U.S. application Ser. No. 07/009,252. The principles of the stroke modification described in these applications permit a cross-wound package to be built up with an exactly cylindrical circumference.

Figure 5:
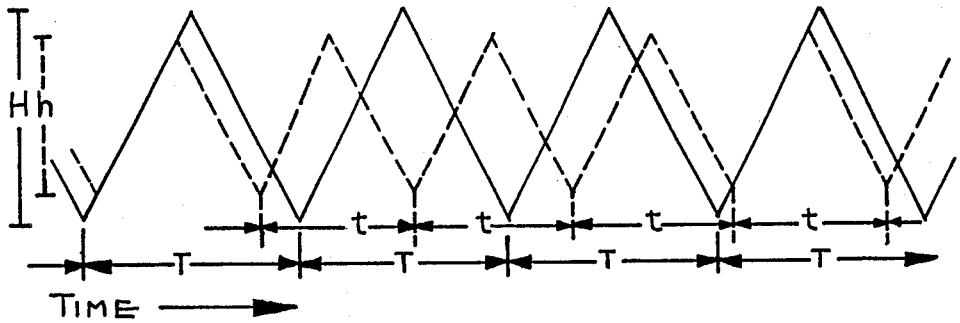
FIG. 5 is a stroke-time diagram illustrating the traversing motion.

The longest traversing stroke H of the yarn guide 7 is plotted on the ordinate or vertical direction in the diagram of FIG. 5 while the shortest traversing stroke of the yarn guide 7 is illustrated in the dotted line indicated at h. The abscissa represents the time axis in the horizontal direction. The solid line illustrates the course of movement of the traversing yarn guide over the entire stroke H along the time axis. The dotted line illustrates the course of the traversing motion of the yarn guide 7 over the shortest stroke h along the time axis. A reciprocal motion is described as a double stroke of the yarn guide 7. The number of double strokes per unit of time is described as the double stroke rate, or as used in the present application, as the traversing frequency. The duration T or t of one reciprocal movement is described as double stroke time. As shown in FIG. 5, the double stroke time is dependent on the length of a traversing stroke of the yarn guide 7. Therefore, the traversing frequency 1/T is smaller at a long stroke H than the traversing frequency 1/t at a short traversing stroke h. Also, the traversing speed dH/dT is equal at a long stroke H to the traversing speed dh/dt at a short stroke h. Thus, the stroke modification according to the present invention does not result in a variation of the traversing speed. Therefore, the winding speed and thus also the yarn tension during the takeup remain constant.

On the other hand, the traversing frequency (double stroke rate) is a critical factor in the development of ribbons. A ribbon of the first order will develop if the winding ratio, i.e., the ratio of winding speed to double stroke rate, is an integral number. Ribbons of a low order will develop if the winding ratio deviates from the next integral winding ratio by a large fraction having an integral denominator (in particular, one-half, one-third, or one-fourth). As a result of the periodic stroke modification cycles according to the present invention, the following altlernatives for breaking or preventing ribbons are possible: (1) a permanent shortening of the traversing stroke avoids the development of critical, ribbon-prone winding ratios, or (2) critical, ribbon-prone winding ratios can be traversed rapidly. As an additional alternative, the winding ratio may be varied periodically or aperiodically in the fashion of a wobbling, and ribbon symptoms may be avoided in that the ribbon-prone winding ratios are traversed only temporarily.

Figure 6:
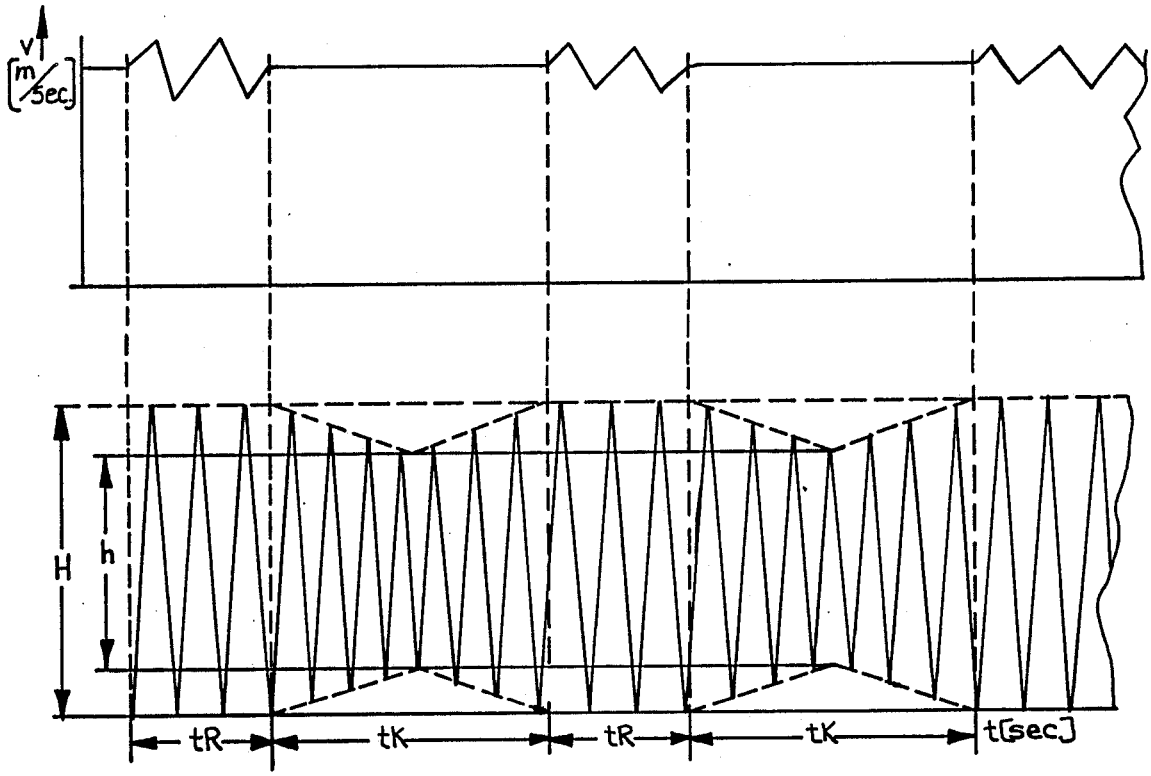
FIG. 6 is a time diagram illustrating the traversing motion and the traversing speed of the yarn guide.

FIG. 6 illustrates the time slope of the traversing motion in the lower portion and the time slope of the traversing speed in the upper portion. In both the upper and lower portions of FIG. 6, the abscissa represents the horizontal time axis. The ordinate or vertical direction of the lower portion of the diagram illustrates the strokes H and h respectively. It should be noted that the slope of the inwardly curved plot or plotted curve illustrates the traversing speed. The variations of the traversing speed which result from the upper portion of the diagram cannot be seen in the lower portion of the diagram because of their relatively small magnitude and because of the distorted illustration of the lower portion of the diagram.

As will be noted from the lower portion of the diagram of FIG. 6, the shortening of the stroke occurs during the times tK, which may be referred to as the stroke modification cycles. During these times, the stroke length progressively shortens until the minimum stroke length h is reached, and then it progressively increases back to the maximum length H. No shortening of the stroke length occurs during the periods of rest tR.

As shown in the upper portion of the diagram of FIG. 6, the traversing speed V (with the dimension m/sec.) remains constant during the stroke modification cycles in which the stroke is shortened. A wobbling occurs during the periods of rest tR, in which the traversing speed is continuously varied periodically or aperiodically, but at least recurrently, with a variation of up to ten percent from the average value. Such a wobbling for the purpose of breaking or avoiding ribbons, is known per se, and may be achieved by the program control unit 28 controlling the package drive 59, and as illustrated schematically in FIG. 1. During the stroke modification cycles when a stroke shortening is taking place, such a ribbon breaking is not necessary.

Figure 7:
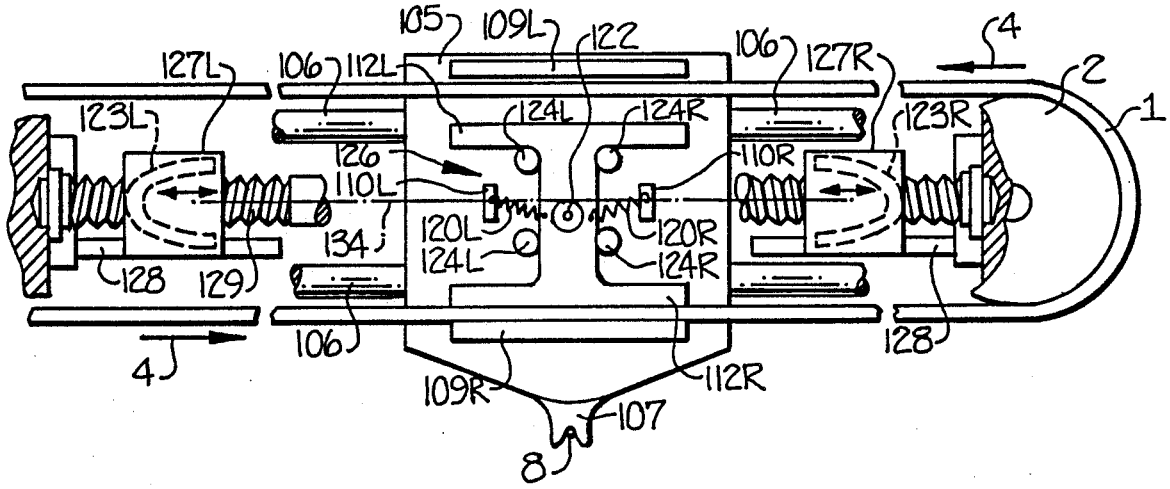

In the embodiment of FIG. 7, the revolving belt 1 is tensioned between the two pulleys 2, 3 and rotates in direction 4. The belt may extend over several winding positions as shown in FIG. 11, and a slide 105 is associated with each winding position. Each slide 105 moves along the straight guideways 106 between the two parallel belt runs, and each slide 105 includes a traversing yarn guide 107 which guides the yarn 8 which advances perpendicularly to the plane of the drawing.

Mounted on the slide 105 between the two belt runs is a belt gripper means, which comprises a first clamp 109L mounted on the slide 105 outside of and closely adjacent the belt run moving to the left, and a second clamp 109R mounted on the slide 105 outside of and closely adjacent to the belt run moving to the right. Arranged on the slide between both belt runs is the drive mechanism for the grippers which includes a gripper mounting support 126 and springs 120L, 120R. The gripper mounting support 126 is movably guided along a path of travel, and it is flat and has the shape of the cross section of an I-beam. The path of the gripper mounting support is defined by guide rolls 124L and 124R, and extends in a lateral direction, i.e., perpendicularly to the direction of the belt runs. To this end, the central cross bar of the gripper mounting support 126 is moved between the guide rolls 124L, 124R. The opposite ends of the gripper mounting support 126 define movable clamps 112L and 112R. When reciprocating the gripper mounting support 126, the clamps 112L and 112R, respectively, can be moved to their clamped position. In the clamped position, the respective belt run is clamped between the clamps 112L or 112R and the stationary clamp 109L or 109R. Shown in FIG. 7 is a clamped condition effected by the clamp 112R. The gripper mounting support 126 with the clamps 112L. and 112R is biased by pressure springs 120L and 120R to each of their respective clamped positions. The pressure springs are mounted at one end by the brackets 110L, 110R on the slide 105, with the spring brackets being arranged exactly along the center line 134 of slide 105, and also centrally between the clamped positions of the gripper mounting support 126. The other end of each of the pressure springs is mounted on the central cross bar of the mounting support 126, i.e., precisely on the center line between the two clamps 112L and 112R. The distance between the clamps 112L and 112R is smaller than the distance between the belt runs. As a result of the forces of springs 120L and 120R being identical and opposite to each other, it is accomplished that the gripper mounting support does not exert any significant normal forces on the guide rolls 124L, 124R and, therefore, is guided free of friction.

Arranged in the center of the mounting support 126, between the two grippers 112L and 112R, is a switching member for the gripper drive mechanism in the form of a guide or roller 122. The axis of the roller 122 extends perpendicularly to the central cross bar of the mounting support. Arranged at the ends of the traverse stroke are stops 123L and 123R, which may be stationary. However, they may also be supported on brackets 127L and 127R, which are movable in the direction of the arrow, i.e., in the direction of the traverse stroke. To this end, the brackets 127L and 127R may be connected by a threaded spindle 129, the drive of which is not shown in FIG. 7. The stops 123L and 123R, are each constructed as a guide surface for the roller 122, and have the form of a cam which is unilaterally open toward the roller 122. The width of the opening of this cam corresponds to the path of the gripper mounting support 126 between the two clamped positions, increased by the diameter of the roller 122. The flanks of the cam in the area of the opening are aligned substantially tangential to the path of movement of the roller 122. Otherwise, the cam is shaped to permit a steady motion which is free of jerks and shocks.

To now describe the operation of the embodiment of FIG. 7, the traversing slide 105 moves to the right as illustrated, since it is clamped by the stationary clamp 109R and the movable clamp 112R on the belt run moving to the right. The slide continues to move to the right until the switching roller 122 moves into the right-hand stop 123R. Due to the alignment of the cam opening, this movement occurs free of jerks and shocks. The roller 122 then slides along the cam surface of the stop 123R, and as a result, the gripper mounting support 126 is caused to move upward, i.e. in a direction toward the upper belt run. This movement continues until the lowest point of the cam surface is reached, thereby releasing entirely the clamping of the slide with the belt. In addition, the slide has then reached the end of the traverse stroke. As the stop roller 122 continues to slide in the stop 123R, an acceleration in the opposite direction is imparted to the slide 105. However, at that same time, the mounting support 126 has overcome the dead center position of the pressure springs 120L, 120R, i.e., the center line between the two clamping positions of its grippers. Consequently, the pressure springs now force the mounting support 126 to the other clamping position, in which the movable clamp 112L clamps the belt run between itself and the stationary clamp 109L. The upper belt run then moves the slide 105 to the left until the reversing operation repeats in the left hand area of the stroke reversal.

The brackets 127L and 127R are supported on a threaded spindle 129 and secured against rotation by a guideway 128. The threaded spindle may be manually operated as a function of the package diameter, or as a function of time, or in accordance with a present program in the manner described above. As a result of this operation, the position of the stops 123L and 123R, and thus the length of the traverse stroke, are changed.

Figure 8:
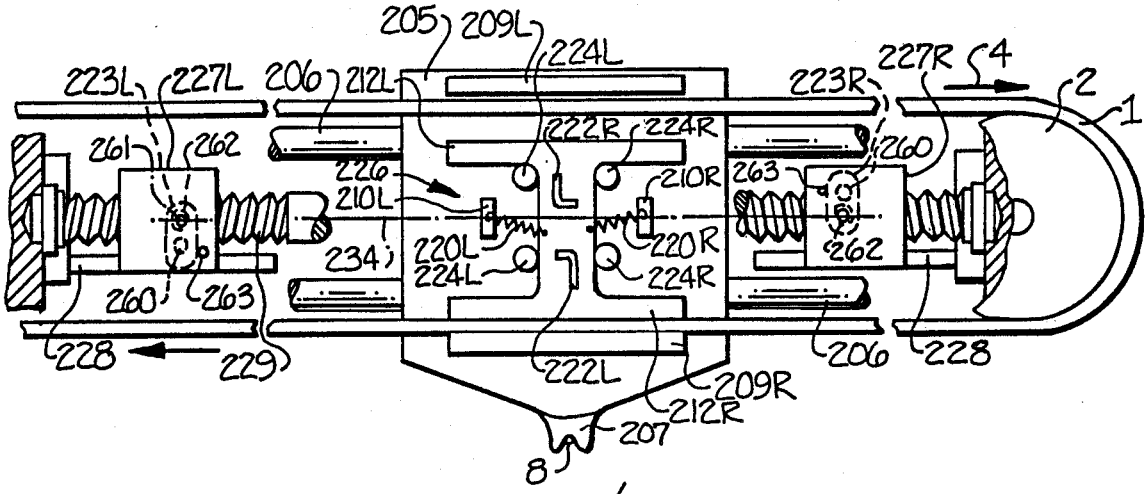
FIGS. 7–10 are schematic plan views of additional embodiments of the yarn traversing apparatus of the present invention.

FIG. 8 illustrates an embodiment wherein rocking levers 223L and 223R are used as stops rather than cam surfaces, and wherein each rocking lever is contacted by the gripper mounting support 226 in the stroke reversal areas. By pivoting the rocking lever 223L or 223R, respectively, the gripper mounting support 226 is moved between its clamping positions. To this end, each rocking lever has at its free end a pin 260, and the gripper mounting support 226 is provided with two guide brackets 222L and 222R, of which one each cooperates with the pin of its associated rocking lever. The guide brackets are fixed to the top of the support 226 and each has a flank which is adjacent and substantially parallel to the longitudinal center line 234 between the belt runs, and a lateral flank which is perpendicular to the center line 234. The rocking arms 223R, 223L are pivotal about a pivot axis 261, which is perpendicular to the center line 234. The pin 260 is fixed to the lower surface of the rocking arm adjacent its free end, and a spring 262 is provided for rotating the rocking arm counterclockwise as seen in FIG. 8 so as to engage a stop 263 which is mounted on the lower surface of the rocking arm.

As seen in FIG. 8, the slide 205 moves in the direction 4, which is to the left. The longitudinal flank of the bracket 222L will thus run onto the pin 260 of the rocking arm 223L, and as a result, the arm 223L pivots by 90°, and the pin 260 urges the flanks of the bracket 222L, and thus the support 226, upwardly. By its inertia, the support 226 moves far enough, so that pressure springs 220L, 220R urge support 226 into abutment with the other belt run moving to the right. After the slide is reversed, the rocking lever is returned by the spring 262 to its initial position, which is defined by the stop 263. The guide brackets may be aligned so that, after half a pivotal motion of the rocking lever, the gripper mounting support 226 has already passed the dead center of its spring support and is then pushed by the spring force to its other clamping position. Reference may be made to FIG. 7 for a description of the other components illustrated in FIG. 8.

Figure 9:
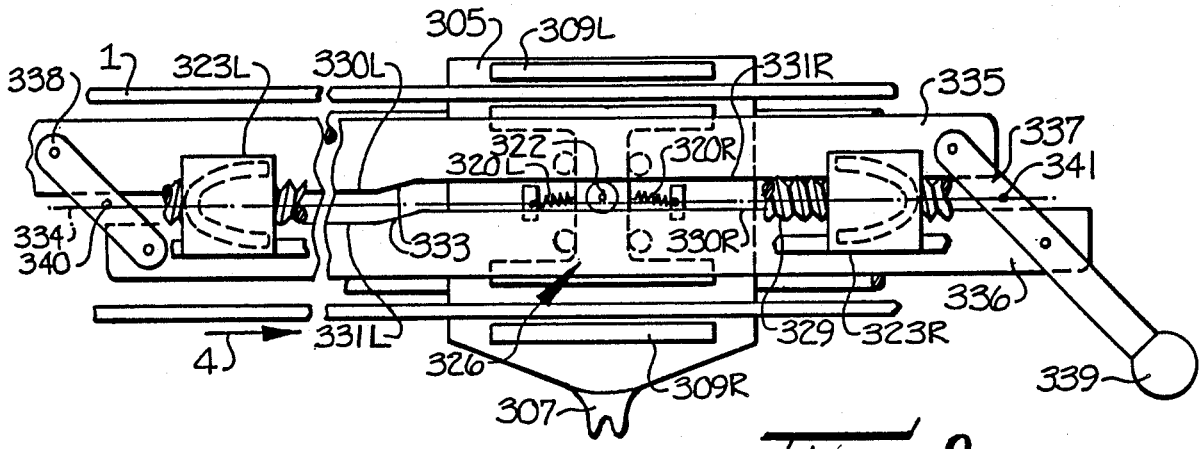

The embodiment of FIG. 9 corresponds substantially to that of FIG. 7 and, consequently, the description of FIG. 7 may also be applied to this embodiment. However, the embodiment of FIG. 9 is also provided with a traverse disengaging means, which is able to stop the slide 305, and which also serves the purpose of putting the slide 305 back in operation. To this end, the disengaging means comprises a pair of rods 335, 336 having opposed edges defining shifting rails 330L and 330R, and stopping rails 331L and 331R. The shifting rail 330L, and the shifting rail 330R, each extend over about half the length of the traverse stroke, i.e., up to the center of the traverse stroke. The shifting rails extend substantially parallel to the traverse stroke, and are arranged on opposite sides of the center line 334 between the two runs of the belt 1. In their operative position the shifting rails are at a distance from the center line 334, which is smaller than the radius of roller 322, which moves the gripper mounting support between its clamping positions. Also, the shifting rails 330R and 330L are each arranged in its half of the traverse stroke on that side of the center line 334 in which the belt run moves to the stroke end adjadent that half of the traverse stroke.

The stopping rails 331L and 331R are each located on the other side of the center line 334, and opposite respective ones of the shifting rails 330L and 330R. The distance of the stopping rails 331R and 331L respectively from the center line is greater than the radius of the roller 322, but smaller than half the path which the gripper mounting support 326 travels between its two clamping positions.

The shifting rail 330R and the stopping rail 331L, which are located on the same side of the center line 334, as well as the shifting rail 330L and the stopping rail 331R which are located on the other side of the center line 334, are each firmly connected by the connecting rails 333 formed on the rods 335 and 336. The two rods 335, 336 are interconnected at each of their ends by two parallel levers 337, 338, which can be pivoted by a handle 339. To this end, the parallel levers 337, 338 are pivotally mounted at the fulcrums 340, 341, respectively. The fulcrums 340, 341 are located on the center line 334 between the two belt runs.

The operation of the embodiment of FIG. 9 will now be described. By actuating the hande 339, the parallel levers 337, 338 are pivoted to a position in which the parallel levers extend substantially perpendicularly to the direction of the traverse, i.e., perpendicularly to the center line 334. As a result, the distance between the oppositely facing shifting rail 330R and stopping rail 331R, and between the shifting rail 330L and stopping rail 331L is sufficiently large so that as the gripper mounting support 326 moves between its clamping positions, the roller 322 does not contact any of the rails. The handle 339 remains in this position during the operation of traversing system.

For the purpose of stopping the slide 305 while the belt 1 rotates, the handle 339 is pivoted to the illustrated position, in which the shifting rails, on the one hand, and the stopping rails, on the other are at the above defined distance from the center line. As result, the roller 322 slides along the shifting rails on the one hand, and along the stopping rails, on the other, to an intermediate position, which is characterized by the following: first, both grippers are raised from the belts, so that the slide 305 is no longer carried along by one of the belts. Second, the gripper mounting support 326 takes a position in which the springs 320L and 320R are no longer on their dead center line, i.e., they are no longer on the center line 334. Rather, the springs 320L and 320R are in a position in which they exert a force in the direction of the belt run which continues to move away from the half of the traverse stroke which includes the engaged shifting and stopping rails. In the illustration of FIG. 9, this would be the upper belt run. If the slide were in the left hand half of the traverse stroke, the gripper mounting support 326 would be moved beyond the center line 334 so that the springs 320L and 320R would exert a force toward the lower belt run. When now the parallel levers 337, 338 are again pivoted, it is ensured that the traversing slide will at least travel half the traverse stroke before it reaches the end of the stroke. As a result, it is ensured that the resulting acceleration is adequate to impart to the slide the necessary speed for carrying out the stroke reversal.

When a winding machine is to be restarted after a shutdown, the slides associated to the individual winding positions may be at any point along the traverse stroke. The handle 339 is then pivoted at each winding position to the illustrated position, in which the shifting and stopping rails are least spaced apart. No matter where the slide 305 is located, it is ensured that the gripper mounting support is moved to a position in which the springs 320L and 320R exert a force in the direction of the belt run, which, as indicated above, must still travel at least half the traverse stroke before reaching the end of the traverse stroke. Even though the startup of the belt is slow, adequate time is available to impart to the slide 305 an adequate speed for the stroke reversal. It should be understood that the switching device of FIG. 9 can also be used in the embodiment of FIG. 7 as well as in the embodiment of FIG. 10 as described below.

Figure 10:
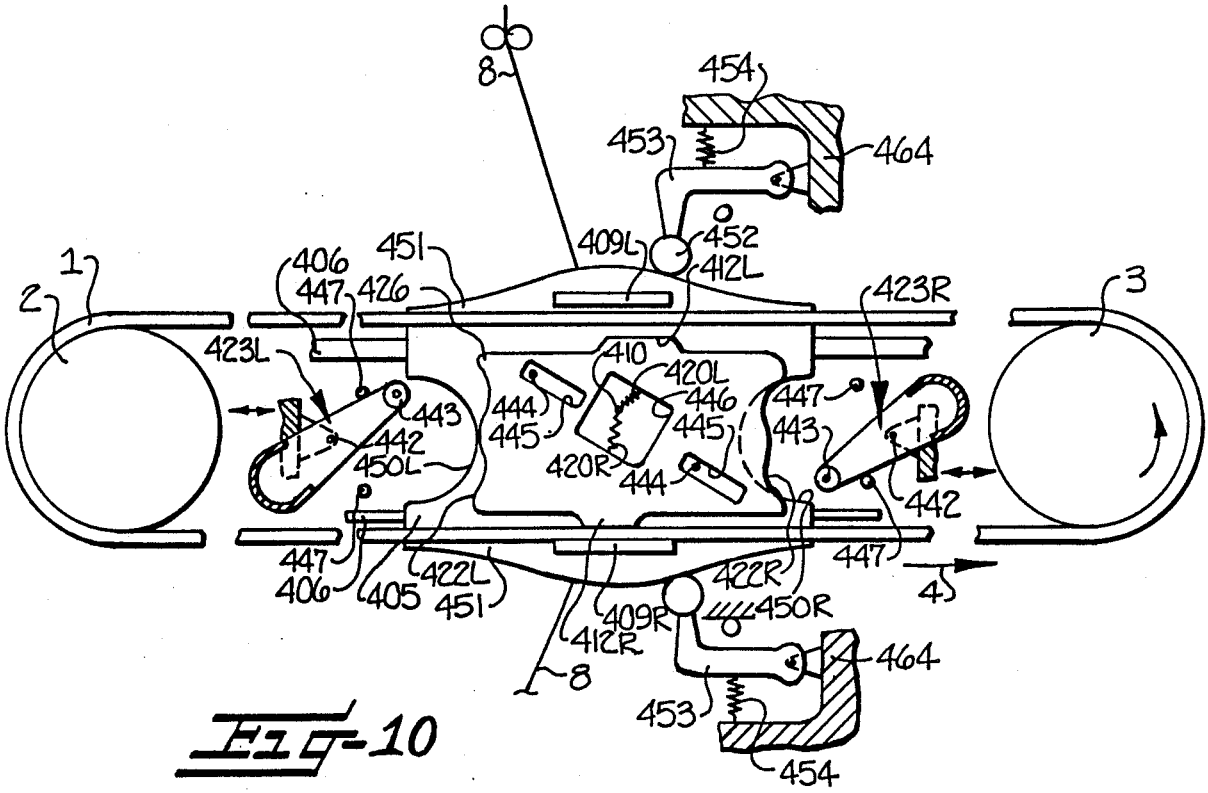

FIG. 10 illustrates a yarn traversing system, in which an endless belt 1 is driven via pulleys 2 and 3, and so that the belt revolves in the direction 4. A slide 405 moves in straight guideways 406 which extend parallel to the belt runs. Attached to the rear side of the slide 405 is yarn guide (not shown), which traverses a yarn 8 advancing parallel to the plane of the drawing, and transversely to its direction of advance, i.e. over a certain traverse stroke.

The slide 405 mounts fixed clamps 409L and 409R, which each embrace the belt run from the outside. In each area of the stroke end, a stop 423L, 423R is provided which is in the form of a rocking lever. The rocking levers are supported for rotation about the axes 442. On their free ends, the rocking levers mount a slide member 443 in the form of a pin or a roll. The stops 423L and 423R area each movable on brackets in the direction of the traverse, and as indicated schematically by the arrows in FIG. 10. The brackets may be such as also shown and described in conjunction with FIG. 7 and 9, i.e., the brackets may be mounted on supports, which are reciprocated by a threaded spindle, which is rotatable.

The drive mechanisms for the grippers consist of a mounting support 426, which is moved to its clamping position by springs 429L and 420R. The gripper mounting support 426 is a substantially rectangular plate provided with oblong slots 445. These oblong slots extend transversely to the direction of movement of the slide, so that the connecting line of the oblong slots forms an acute angle at the intersections with the belt runs, i.e., with each arriving belt run. Guide pins 444, which are firmly mounted on the slide 405, extend into the oblong slots 445. The gripper mounting support is thus moved by these pins 444 transversely to the direction of the traverse, and between the two clamping positions.

Movable clamps 412L and 412R are defined along the sides of the gripper mounting support 426 which extend parallel to the belt runs. In the clamping position of the mounting support 426, the one or the other clamp 412L or 412R engages with the respective belt run and clamps the same with the stationary clamps 409L or 409R, respectively.

An abutment 410 is mounted on the slide, and two springs 420L and 420R are attached to the abutment 410. To this end the gripper mounting support has an opening 446 in the area of the abutment 410. Two of the lateral flanks of this opening extend parallel to the oblong slots 445, and the springs are fixed to the support 426 at these lateral flanks. The attachment of the pressure springs 420L and 420R on the lateral flanks of the opening is positioned so that the springs are exactly aligned and extend perpendicularly to the connecting line of the oblong slots, when the gripper mounting support 426 is in the middle between its end or clamping positions.

Arcuate recesses 450L and 450R are formed on the ends of the slide which extend transversely to its direction of movement. These recesses are each concave in the direction of the respective stroke end. In the stroke reversal areas, these recesses cooperate each with the stationary stop 423L or 423R, each constructed as a rocking lever, and cause the slide to brake or accelerate in the stroke reversal areas. The rocking levers can each have a large mass, such that they are in a position, as the pivoting motion is forced upon them, to store a large portion of kinetic energy and then impart same again to the slide 405.

As illustrated in FIG. 10, the recess 450R which is provided on the right hand side of the slide, is in part covered by the lateral flank 422R of the gripper mounting support 426, as the slide 405 moves into the stroke reversal area. On the rear side of the slide 405, the slide covers the corresponding lateral flank of the gripper mounting support 426, and the recess 450L is entirely exposed. In the illustrated embodiment, the lateral flank 422R or 422L of the gripper mounting support 426 serving as a guide bracket is arcuately curved, i.e., concave with regard to the respective stroke end. However, adjacent the longitudinal center line of the gripper mounting support 426, this curve is provided with a bulge.

To now describe the operation of the embodiment of FIG. 10, it will be seen that in the illustrated position, the slide 405 is carried along in the direction of movement 4, by the lower belt run, which is clamped between movable clamp 412R and clamp 409R, and it is moved to the right-hand stroke reversal area. The stationary rocking lever 423R rests against a stop 447. The recess 450R is shaped so that it moves with its end substantially tangentially against the slide member 443 of the rocking lever 423R, and as a result, the rocking lever 423R is pivoted clockwise, and the slide member 443 moves along the recess 450R. In so doing, the slide member 443 also contacts the lateral flank 433R of the gripper mounting support 426, thereby displacing the gripper mounting support 426 relative to the slide 405 on the guide pins 444 in the oblong slots 445, and traversely to the direction of the belt, thereby disengaging the clamp 412R from the belt. As a result of the arcuate construction of the lateral flank 433R it is accomplished that the gripper mounting support 426 moves free of shocks. The bulge provided at the bottom of the curved flank 422R imparts to the gripper mounting support an additional acceleration before it reaches the middle position between its two clamping positions, which overcomes the force of the springs 420R, 420L and causes the springs to pass beyond their dead center position. The gripper mounting support 426 then moves, relative to the slide 405, under the reversed direction of the spring force, automatically to the clamping position in which the clamaps 412L and 409L engage the belt. Since the upper belt run moves in a direction away from the stroke end, and since the direction of the belt forms an acute angle with the guidance of the gripper mounting support 426 in the oblong slots 445, the belt also exerts a force on the gripper mounting support in its direction of movement relative to the slide and forces the gripper mounting support into its clamping position. Consequently, the clamping forces need not be applied entirely by the springs 420R and 420L, which rather serve the primary purpose of moving the gripper mounting support 426 to its clamping position and ensuring a clearly clamped position.

The traversing apparatus shown in FIG. 10 is also provided with means for accelerating the slide toward each of the ends of the stroke path to assure that the springs 420R and 420L pass through their dead center position. This accelerating means can be applied to any of the above described traversing systems, and thus the following description and the drawing also apply to the previously shown embodiments.

The slide 405 has an acceleration rail 451 on each of its two opposite edges which are parallel to the belt runs. Facing the respective stroke end, each acceleration rail has, relative to the traversing direction, a leading flank and a trailing flank on the other side. The angles of inclination are identical. Each acceleration rail cooperates with a sliding member 452, which is movable along a fixed path which extends transversely to the traversing direction. The sliding member 452 is preferably a roll, which is supported on a rocking lever 453. The lever 453 extends substantially parallel to the traversing direction and is supported by a spring 454 transverse to the traversing direction. A holder 464 for the rocking lever is, if desired, movable together with the rocking levers 423L and 423R, which operate as stationary stops, and thus participate in the displacement of the stroke end.

Upon the entry of the slide 405 into a stroke reversal area, the roll 452 contacts the leading flank of the acceleration rail 451 and moves upwardly along the same. As a result, the pressure spring 454 which is operative on the roll 452, is compressed, since the cooperating pair of clamps 409R and 412R (or 409L and 412L) continues to clamp the belt. The sliding member 452 then rolls downwardly along the trailng flank of the acceleration rail. In so doing, the energy stored in spring 454 is converted into an acceleration of the slide 405 in the direction of the stroke end, since in this phase of the movement the pertinent gripper pairing 409L, 412L (or 409R, 412R) is no longer engaged. Consequently, a large force can be imparted to the slide 405 so that the gripper mounting support is moved with an adequate certainty through and beyond the dead center position of the spring system, and to thereby assure reversal of the slide. This type of reversing auxiliary is particularly advantageous in connection with the embodiment of FIG. 10, in which the clamping force of the gripper means is not exerted by spring force but by a self-locking effect.

Figure 12:
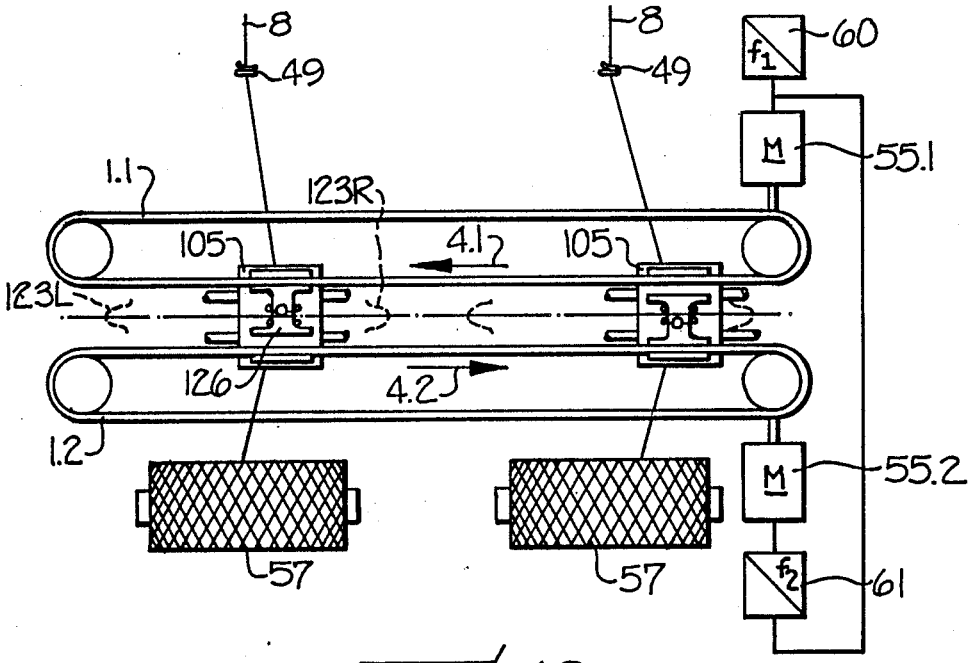
FIG. 12 is a schematic side elevation view of a further embodiment of a winding machine having several winding stations in accordance with the present invention.

FIGS. 11 and 12 are schematic views of winding machines with a plurality of side by side winding stations or positions. In FIG. 11, several yarns 8 advance from a delivery system 47 and a yarn guide 49 to their respective winding positions. The endless revolving belt 1 extends over three winding positions, and the belt pulley 2 is driven by a motor 55. A slide 5 is positioned at each winding position, and the slides move along the rods 6 serving as a straight guideway and which extend over the three illustrated winding positions. The drive mechanism for the grippers is reversed by the stops 23L and 23R, which are each arranged on brackets and can be longitudinally moved toward and away from each other by a threaded spindle 29. A motor 64 drives the threaded spindles, via an intermediate shaft 65 and pairs of gears 56. Associated with each winding position is a startup auxiliary which comprises the rods 335, 336 of FIG. 9. The rods may be operated by a handle 339, separately for each winding position, so as to start or stop the operation of the traversing motion. The yarn at each position is wound on a core supported package 57, which is freely rotatably supported on a spindle and driven on its circumference by a drive roll 58. The drive rolls 58 of the three winding positions are commonly driven by a motor 59. Otherwise, any of the embodiments of the present invention may serve as a yarn traversing system.

FIG. 12 is a top plan view of a further embodiment of a winding apparatus in accordance with the present invention. The winding apparatus may correspond substantially to that of FIG. 11, except that the traversing apparatus corresponds to that shown in FIG. 7. Also, the yarn traversing system is not driven by a single belt, but by two endless, revolving belts 1.1 and 1.2. Each of these belts is driven by a motor 55.1 and 55.2. Frequency generators 60 and 61 permit the motors and the belts to be driven at different speeds. The slides 105, which are associated to each winding position, are driven by alternate ones of the belts, with the direction of movement 4.1 and 4.2 of the belt runs being opposite. The stationary stops 123L and 123R are each shown as stop cams in dashed lines. For other details, reference should be made to the description of FIG. 11.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A method of breaking the formation of ribbons while winding a textile yarn into a cross-wound package and comprising the steps of rotating the package, while traversing a yarn guide across the rotating package and such that the yarn is wound about the package at a substantially constant rate which is substantially equal to the geometrical sum of the peripheral speed of the package and the traverse speed, and wherein the traverse speed is at least about 3.5% of the peripheral speed of the package, and including the stop of periodically or aperiodically varying the traversing frequency by shortening and lengthening the stroke of the traversing yarn guide while maintaining a constant traversing speed of the traversing yarn guide.

2. The method according to claim 1, wherein the traversing step includes periods of rest wherein the stroke of the traversing yarn guide is substantially unchanged, and including the further step of breaking the formation of ribbons by varying the traversing speed of the traversing yarn guide during said periods of rest.

3. A method of winding textile yarn onto core supported packages comprising the steps of rotating the package, while traversing a yarn guide across the rotating package such that the yarn is wound about the package at a substantially constant rate, and wherein said constant rate is substantially equal to the geometrical sum of the peripheral speed of the package and the traverse speed, and including the stpes of rotating the core supported package at a substantially constant peripheral speed, while controlling the traverse of the yarn guide in a recurrent series of stroke modification cycles in which the length of the strokes of the yarn guide is progressively decreased and then progressively increased, and while maintaining a constant traversing speed of the traversing yarn guide during each stroke modification cycle which is at least 3.5% of the peripheral speed of the package.

4. The method according to claim 3 wherein during each stroke modification cycle, the length of the strokes is decreased and then increased at each of the ends of the strokes.

5. The method according to claim 4 wherein the traversing step includes periods of rest wherein the stroke of the traversing yarn guide is substantially unchanged, and comprising the further step of varying the traverse speed during said periods of rest by alternately increasing and decreasing the traverse speed and so as to prevent undesirable ribbon formation in the yarn windings in the package formed thereby.

6. The method according to claim 4 wherein during each stroke modification cycle, the length of the strokes is progressively decreased from a maximum stroke length to a minimum stroke length and then progressively increased back to said maximum stroke length, and wherein the maximum and minimum stroke lengths are substantially the same among the stroke modification cycles.

7. The method according to claim 4 wherein the yarn guide is traversed at a constant speed which is at least 5.7% of the peripheral speed of the package during each stroke modification cycle.

8. A yarn traversing apparatus adapted for guiding a running yarn onto a rotating core to form a core supported package, and comprising a slide fixedly mounting a yarn guide, means mounting said slide for back and forth movement along a linear stroke path, drive means for moving said slide back and forth along said stroke path at a uniform speed in each direction which is at least about 3.5% of the speed of the running yarn, said drive means including stop means positioned adjacent each of the ends of said stroke path so as to be engaged by the slide upon reaching the associated end of the stroke for effecting reversal of the movement, control means for adjustably moving at least one of said stop means for inward and outward movement relative to each other to thereby permit adjustment of the stroke length, and whereby the length of the stroke of the slide may be changed while the traversing speed is unchanged, and said drive means including means for rendering said control means inoperative so as to define periods of rest wherein the stroke of the traversing yarn guide is substantially unchanged, and for varying the traverse speed of the slide during said periods of rest.

9. The yarn traversing apparatus as defined in claim 8 wherein said control means is operatively connected to each of said stop means so as to concurrently move the same inwardly and outwardly.

10. A yarn winding apparatus comprising a plurality of side by side yarn winding stations, with each winding station comprising a spindle adapted for coaxially receiving a core for receiving the yarn to form a core supported package, means for rotatably driving the package being formed at a constant peripheral speed, a slide fixedly mounting a traversing guide, conveyor belt means having parallel opposing runs, means for driving said conveyor belt means at a constant linear speed which is at least about 3.5% of the peripheral speed of the package, and with said runs moving in opposite directions, means mounting said slide for movement back and forth along a straight line stroke path between said opposing runs of said conveyor belt means, stop means in the areas of the ends of said stroke path for drivingly connecting said slide to said opposing runs of said conveyor belt in an alternating manner, and means for supporting at least one of said stop means for inward and outward movement relative to the other stop means to provide modification of the stroke of said traversing guide, said apparatus having a single endless conveyor belt extending along the length of said apparatus, with said endless belt having parallel runs which define said conveyor belt means at each of said winding stations.

11. The apparatus as defined in claim 10 further comprising drive means for concurrently moving each of said stop means of each winding station in inward and outward directions.

12. A yarn traversing apparatus adapted for guiding a running yarn onto a rotating core to form a core supported package, and comprising a pair of laterally separated and parallel belt segments, means for driving said belt segments in opposite directions, a slide fixedly mounting a yarn guide, means mounting said slide for back and forth movement along a straight line stroke path between and parallel to said belt segments, gripper means mounted on said slide for movement between a first position engaging one of said belt segments and a second position engaging the other of said belt segments, said gripper means comprising first and second pairs of clamps for engaging respective ones of said belt segments, with each pair of clamps comprising a first member fixed to said slide and a second member movably mounted on said slide for movement toward said first member and so as to engage the associated belt segment therebetween, and control means for moving said gripper means from said first position to said second position at one end of said stroke path and returning said gripper means from said second position to said first position at the other end of said stroke path, and so that said slide and yarn guide are reciprocated along said stroke path, said control means comprising (a) a pair to stops mounted adjacent respective ends of said stroke path, (b) cam means mounted on said slide for movement between a first location and a second location and so as to be engaged by said stop at each end of said stroke path to thereby be alternately shifted between said first and second locations, said cam means comprising first and second curved spring blades mounting respective ones of said movable second members, an indexing cam pivotally mounted to said slide between said spring blades and so as to define said first and second locations, and an arm pivotally mounted to said slide and being operatively connected to said indexing cam, with said arm being configured to engage said stops at the ends of the stroke path and so that said arm is pivoted in alternate directions and said indexing cam is moved between said first and second locations and engages alternate ones of said spring blades in said first and second locations to thereby straighten the engaged blades and thereby move the associated movable second member toward the associated fixed first member, (c) means operatively interconnecting said cam means and said gripper means such that said gripper means is moved to said first position upon said cam means being moved to said first location, and such that said gripper means is moved to said second position upon said cam means being moved to said second location, and (d) spring biasing means fixed to said slide and said cam means for biasing said cam means toward said first location when said cam means is in said first location, and for biasing said cam means toward said second location when said cam means is in said second location, and with said spring biasing means having a dead center position of maximum force when said cam means is intermediate said first and second locations.

13. The yarn traversing apparatus as defined in claim 12 wherein said spring biasing means comprises a spring which is tensioned and which is connected between said slide and said indexing cam.

14. The yarn traversing apparatus as defined in claim 13 wherein said indexing cam and said arm are separately pivotal about a common axis, and wherein said arm is operatively connected to said indexing cam by lost motion interconnection means.

15. The yarn traversing apparatus as defined in claim 14 further comprising a second spring interconnected between said slide and said arm for biasing said arm toward each of two pivotal positions corresponding to said first and second locations of said indexing cam.

16. A yarn winding apparatus comprising a plurality of side by side winding stations for winding a yarn at each of the stations, a corresponding number of spindles coaxially aligned to each other and associated to each of the winding stations for coaxially receiving a core for receiving the yarn to form a core supported package, means for rotatably driving each of the packages being formed at a constant peripheral speed, conveyor belt means having parallel opposing segments, said segments being parallel to and extending over the length of said number of spindles, means for driving said conveyor belt means at a constant linear speed which is at least about 3.5% of the peripheral speed of the package, and with said segements moving in opposite directions, and wherein each of the yarn winding stations further comprises a slide mounting a yarn traversing guide, means mounting said slide for back and forth movement along a straight line stroke path between and parallel to said belt segments, gripper means mounted on said slide for movement between a first position engaging one of said belt segments and a second position engaging the other of said belt segments, and control means for moving said gripper means from said first position to said second position at one end of said stroke path and returning said gripper means from said second position to said first position at the other end of said stroke path, and so that said slide and yarn guide are reciprocated along said stroke path, said control means comprising (a) a pair of stops mounted adjacent respective ends of said stroke path, (b) cam means mounted on said slide for movement between a first location and a second location and so as to be engaged by said stop at each end of said stroke path to thereby be alternately shifted between said first and second locations, (c) means operatively interconnecting said cam means and said gripper means such that said gripper means is moved to said first position upon said cam means being moved to said first location,.and such that said gripper means is moved to said second position upon said cam means being moved to said second location, and (d) spring biasing means fixed to said slide and said cam means for biasing said cam means toward said first location when said cam means is in said first location, and for biasing said cam means toward said second location when said cam means is in said second location, and with said spring biasing means having a dead center position of maximum force when said cam means is intermediate said first and second locations.

17. The yarn winding apparatus as defined in claim 16 further comprising means for movably supporting at least one of each pair of stops associated with each of the winding stations, for inward and outward movement relative to the other stop to provide modification of the stroke of said traversing guide, and common drive means associated with said plurality of winding stations for synchronously moving said supporting means.

18. A yarn winding apparatus comprising a plurality of side by side yarn winding stations, with each winding station comprising, a spindle adapted for coaxially receiving a core for receiving the yarn to form a core supported package, means for rotatably driving the package being formed at a constant peripheral speed, a slide fixedly mounting a traversing guide, conveyor belt means having parallel opposing runs, means for driving said conveyor belt means at a constant linear speed which is at least about 3.5% of the peripheral speed of the package, and with said runs moving in opposite directions, means mounting said slide for movement back and forth along a straight line stroke path between said opposing runs of said conveyor belt means, stop means in the areas of the ends of said stroke path for drivingly connecting said slide to said opposing runs of said conveyor belt in an alternating manner, and means for supporting at least one of said stop means for inward and outward movement relative to the other stop means to provide modification of the stroke of said traversing guide, said apparatus having a pair of endless belts extending along the length of said apparatus, with said endless belts having opposing parallel runs which define said conveyor belt means at each of said winding stations.

19. The yarn winding apparatus as defined in claim 18 wherein said means for driving said conveyor belt means comprises means for driving said endless belts at independently controllable speeds.

20. The apparatus as defined in claim 19 further comprising drive means for concurrently moving each of said stop means of each winding station in inward and outward directions.

21. A yarn traversing apparatus adapted for guiding a running yarn onto a rotating core to form a core supported package, and comprising a pair of laterally separated and parallel belt segements, means for driving said belt segments in opposite directions, a slide fixedly mounting a yarn guide, means mounting said slide for back and forth movement along a straight line stroke path between and parallel to said belt segments, gripper means mounted on said slide for movement between a first position engaging one of said belt segments and a second position engaging the other of said belt segments, said gripper means comprising first and second pairs of clamps for engaging respective ones of said belt segments, with each pair of clamps comprising a first member fixed to said slide and a second member movably mounted on said slide for movement toward said first member and so as to engage the associated belt segment therebetween, a support member slideably mounted on said slide for movement in the lateral direction, and with said support member having laterally opposite edges which define said movable second members of said gripper means, and control means for moving said gripper means from said first position to said second position at one end of said stroke path and returning said gripper means from said second position to said first position at the other end of said stroke path, and so that said slide and yarn guide are reciprocated along said stroke path, said control means comprising (a) a pair of stops mounted adjacent respective ends of said stroke path, (b) cam means mounted on said slide for movement between a first location and a second location and so as to be engaged by said stop at each end of said stroke path to thereby be alternately shifted between said first and second locations, said cam means comprising a guide mounted on said support member intermediate said second movable members, and wherein each of said stops comprises an arcuate surface adapted for engaging said guide to laterally translate the guide and support member, (c) means operatively interconnecting said cam means and said gripper means such that said gripper means is moved to said first position upon said cam means being moved to said first location, and such that said gripper means is moved to said second position upon said cam means being moved to said second location, and (d) spring biasing means fixed to said slide and said cam means for biasing said cam means toward said first location when said cam means is in said first location, and for biasing said cam means toward said second location when said cam means is in said second location, and with said spring biasing means having a dead center position of maximum force when said cam means is intermediate said first and second locations.

22. The yarn traversing apparatus as defined in claim 21 wherein said spring biasing means comprises at least one spring which is under compression and which is connected between said support member and said slide.

23. A yarn traversing apparatus adapted for guiding a running yarn onto a rotating core to form a core supported package, and comprising a pair of laterally separated and parallel belt segments which define a longitudinal center line therebetween, means for driving said belt segments in opposite directions, a slide fixedly mounting a yarn guide, means mounting said slide for back and forth movement along a straight line stroke path between and parallel to said belt segments, gripper means mounted on said slide for movement between a first position engaging one of said belt segments and a second position engaging the other of said belt segments, said gripper means comprising first and second pairs of clamps for engaging respective ones of said belt segments, with each pair of clamps comprising a first member fixed to said slide and a second member movably mounted on said slide for movement toward said first member and so as to engage the associated belt segment therebetween, a support member slideably mounted on said slide for movement in the lateral direction, and with said support member having laterally opposite edges which define said movable second members of said gripper means, and control means for moving said gripper means from said first position to said second position at one end of said stroke path and returning said gripper means from said second position to said first position at the other end of said stroke path, and so that said slide and yarn guide are reciprocated along said stroke path, said control means comprising (a) a pair of stops mounted adjacent respective ends of said stroke path, (b) cam means mounted on said slide for movement between a first location and a second location and so as to be engaged by said stop at each end of said stroke path to thereby be alternately shifted between said first and second locations, said cam means comprising a guide mounted on said support member intermediate said second movable members, (c) means operatively interconnecting said cam means and said gripper means such that said gripper means is moved to said first position upon said cam means being moved to said first location, and such that said gripper means is moved to said second position upon said cam means being moved to said second location, and (d) spring biasing means fixed to said slide and said cam means for biasing said cam means toward said first location when said cam means is in said first location, and for biasing said cam means toward said second location when said cam means is in said second location, and with said spring biasing means having a dead center position of maximum force when said cam means is intermediate said first and second locations, and a traverse disengaging means which comprises a pair of shifting rails extending along respective halves of the stroke path and on opposite sides of said center line, a pair of stopping rails extending along respective halves of the stroke path and on opposite sides of said center line, and with said stopping rails being opposed to respective ones of said shifting rails, and means for selectively moving said shifting and stopping rails laterally toward and away from each other and so as to be movable between an idle position wherein said guide is not engaged by said rails and is free to move therebetween, and an engaged position wherein said guide and thus also support member are supported at a central location wherein neither one of said belt segments is engaged by said gripper means.

24. The yarn traversing apparatus as defined in claim 23 wherein each shifting rail is positioned on the side of the path of said guide on which the belt segment is located which moves toward the end of the stroke path which includes such shifting rail, and such that in the engaged position the shifting rail pushes the guide beyond the center line and the dead center position of said spring biasing means.

25. A yarn traversing apparatus adapted for guiding a running yarn onto a rotating core to form a core supported package, and comprising a pair of laterally separated and parallel belt segments, means for driving said belt segments in opposite directions, a slide fixedly mounting a yarn guide, means mounting said slide for back and forth movement along a straight line stroke path between and parallel to said belt segments, gripper mean mounted on said slide for movement between a first position engaging one of said belt segments and second position engaging the other of said belt segments, said gripper means comprising first and second pairs of claims for engaging respective ones of said belt segments, with each pair of clamps comprising a first member fixed to said slide and a second member movably mounted on said slide for movement toward said first member and so as to engage the associated belt segment therebetween, a support member slideably mounted on said slide for movement in the lateral direction, and with said support member having laterally opposite edges which define said movable second members of said gripper means, control means for moving said gripper means from said first position to said second position at one end of said stroke path and returning said gripper means from said second position to said first position at the other end of said stroke path, and so that said slide and yarn guide are reciprocated along said stroke path, said control means comprising (a) a pair of stops mounted adjacent respective ends of said stroke path, (b) cam means mounted on said slide for movement between a first location and a second location and so as to be engaged by said stop at each end of said stroke path to thereby be alternately shifted between said first and second locations, said cam means comprising a pair of laterally spaced apart guides mounted to said support member intermediate said second movable members, with each of said guides including a longitudinal flank which is parallel to said belt segments and a lateral flank, and wherein each of said stops comrpises pivotal rocking arm means for engaging a respective one of said guides and laterally translating the same, (c) means operatively interconnecting said cam means and said gripper means such that said gripper means is moved to said first position upon said cam means being moved to said first location, and such that said gripper means is moved to said second position upon said cam means being moved to said second location, and (d) spring biasing means fixed to said slide and said cam means for biasing said cam means toward said first location when said cam means is in said first location, and for biasing said cam means toward said second location when said cam means is in said second location, and with said spring biasing means having a dead center position of maximum force when said cam means is intermediate said first and second locations.

26. A yarn traversing apparatus adapted for guiding a running yarn onto a rotating core to form a core supported package, and comprising a pair of laterally separated and parallel belt segments, means for driving said belt segments in opposite directions, a slide fixedly mounting a yarn guide, means mounting said slide for back and forth movement along a straight line stroke path between and parallel to said belt segments, gripper means mounted on said slide for movement between a first position engaging one of said belt segments and a second position engaging the other of said belt segments, said gripper means comprising first and second pairs of clamps for engaging respective ones of said belt segments, with each pair of clamps comprising a first member fixed to said slide and a second member movably mounted on said slide for movement toward said first member and so as to engage the associated belt segment therebetween, a plate-like support member overlying said slide, and means mounting said support member to said slide for movement in opposite directions along a path which is inclined from the lateral direction extending between said belt segments, and with said support member having laterally opposite edges which define said movable second members of said gripper means, control means for moving said gripper means from said first position to said second position at one end of said stroke path and returning said gripper means from said second position to said first position at the other end of said stroke path, and so that said slide and yarn guide are reciprocated along said stroke path, said control means comprising (a) a pair of stops mounted adjacent respective ends of said stroke path, (b) cam means mounted on said slide for movement between a first location and a second location and so as to be engaged by said stop at each end of said stroke path to thereby be alternately shifted between said first and second locations, (c) means operatively interconnecting said cam means and said gripper means such that said gripper means is moved to said first position upon said cam means being moved to said first location, and such that said gripper means is moved to said second position upon said cam means being moved to said second location, and (d) spring biasing means fixed to said slide and said cam means for biasing said cam means toward said first location when said cam means is in said first location, and for biasing said cam means toward said second location when said cam means is in said second location, and with said spring biasing means having a dead center position of maximum force when said cam means is intermediate said first and second locations.

27. The yarn traversing apparatus as defined in claim 26 wherein said cam means comprises an arcuate edge surface along each of the longitudinally spaced apart edges of said support member, and wherein each of said stops comprises pivotal lever arms means for engaging the adjacent arcuate edge surface and thereby laterally translating said support member.

28. The yarn traversing apparatus as defined in claim 26 wherein the direction of movement of said belt segments is such that the gripper means becomes self tightening upon engagement with each of the belt segments.

29. A yarn traversing apparatus adapted for guiding a running yarn onto a rotating core to form a core supported package, and comprising a pair of laterally separated and parallel belt segments, means for driving said belt segments in opposite directions, a slide fixedly mounting a yarn guide, means mounting said slide for back and forth movement along a straight line stroke path between and parallel to said belt segments, gripper means mounted on said slide for movement between a first position engaging one of said belt segments and a second position engaging the other of said belt segments, and control means for moving said gripper means from said first position to said second position at one end of said stroke path and returning said griper means from said second position to said first position at the other end of said stroke path, and so that said slide and yarn guide are reciprocated along said stroke path, said control means comprising (a) a pair of stops mounted adjacent respective ends of said stroke path, (b) cam means mounted on said slide for movement between a first location and a second location and so as to be engaged by said stop at each end of said stroke path to thereby be alternately shifted between said first and second locations, (c) means operatively interconnecting said cam means and said gripper means such that said gripper means is moved to said first position upon said cam means being moved to said first location, and such that said gripper means is moved to said second position upon said cam means being moved to said second location, and (d) spring biasing means fixed to said slide and said cam means for biasing said cam means toward said first location when said cam means is in said first location, and for biasing said cam means toward said second location when said cam means is in said second location, and with said spring biasing means having a dead center position of maximum force when said cam means is intermediate said first and second locations, and means for accelerating said slide toward each of the ends of the stroke path to assure that said spring biasing means passes through its dead center position.

30. The yarn traversing apparatus as defined in claim 29 wherein said slide includes opposite edges which are generally parallel to said belt segments, and wherein said acceleration means comprises a sliding member mounted adjacent each of the ends of the traverse stroke path, with each of said sliding members being mounted for movement in a direction transverse to the stroke direction and so as to engage one of the opposite edges of said slide, spring means for biasing each sliding member in a direction toward the associated one of the opposite edges of said slide, and wherein each of said opposite edges which is inclined with respect to the stroke direction so as to compress the spring means and a trailing portion which is oppositely inclined so as to release the spring means and thereby accelerate the slide toward the end of the stroke path.

* * * * *

UNITED STATES PATENT AND TRADEMARK OFFICE

CERTIFICATE OF CORRECTION

PATENT NO. : 4,911,370

DATED : March 27, 1990

INVENTOR(S) : Heinz Schippers et al

It is certified that error appears in the above-identified patent and that said Letters Patent is hereby corrected as shown below:

Column 3, line 27, "operation" should be -- operations --

Column 4, line 39, "cotnrol" should be -- control --

Column 6, line 11, "altlernatives" should be -- alternatives --

Column 10, line 57, "area" should be -- are --

Column 11, line 67, "433R" should be -- 422R --

Column 12, line 5, "433R" should be -- 422R --

Column 12, line 16, "clamaps" should be -- clamps --

Column 13, line 68, "stop" should be -- step --

Column 21, line 27, "comrpises" should be -- comprises --

Signed and Sealed this

Third Day of March, 1992

*Attest:*

*Attesting Officer*

HARRY F. MANBECK, JR.

*Commissioner of Patents and Trademarks*